US012753454B2

(12) United States Patent
Doan et al.

(10) Patent No.: US 12,753,454 B2
(45) Date of Patent: Oct. 6, 2026

(54) HIGH STRENGTH STEEL SHEET AND METHOD OF PRODUCING SAME

(71) Applicant: JFE STEEL CORPORATION, Tokyo (JP)

(72) Inventors: Thihuyen Doan, Tokyo (JP); Sota Goto, Tokyo (JP); Hiroshi Hasegawa, Tokyo (JP); Noriaki Moriyasu, Tokyo (JP); Takanori Umino, Tokyo (JP); Takeshi Ueda, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 744 days.

(21) Appl. No.: 17/905,827

(22) PCT Filed: Mar. 11, 2021

(86) PCT No.: PCT/JP2021/009856
§ 371 (c)(1),
(2) Date: Sep. 8, 2022

(87) PCT Pub. No.: WO2021/187321
PCT Pub. Date: Sep. 23, 2021

(65) Prior Publication Data

US 2023/0120827 A1 Apr. 20, 2023

(30) Foreign Application Priority Data

Mar. 17, 2020 (JP) ..... 2020-046886

(51) Int. Cl.

| | |
|---|---|
| ***C21D 9/46*** | (2006.01) |
| ***B21C 47/02*** | (2006.01) |
| ***C21D 8/02*** | (2026.01) |
| ***C21D 8/0221*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C21D 9/46* (2013.01); *B21C 47/02* (2013.01); *C21D 8/0226* (2013.01); *C22C 38/001* (2013.01); *C22C 38/002* (2013.01); *C22C 38/02* (2013.01); *C22C 38/04* (2013.01); *C22C 38/06* (2013.01); *C21D 2211/001* (2013.01); *C21D 2211/002* (2013.01); *C21D 2211/008* (2013.01)

(58) Field of Classification Search
CPC ..... C21D 9/46; C21D 8/0226; C21D 2211/001; C21D 2211/002; C21D 2211/008; C21D 1/18; C21D 6/008; C21D 1/02; C21D 6/005; C21D 8/0205; C21D 8/0263; C21D 8/0236; B21C 47/02; C22C 38/001; C22C 38/002; C22C 38/02; C22C 38/04; C22C 38/06; C22C 38/005; C22C 38/08; C22C 38/12; C22C 38/14; C22C 38/16; C22C 38/32; C22C 38/38; C22C 38/60; C22C 38/22; C22C 38/42; C22C 38/58
See application file for complete search history.

(56) References Cited

U.S. PATENT DOCUMENTS

| | | | | |
|---|---|---|---|---|
| 9,322,088 | B2 | 4/2016 | Mizuta et al. | |
| 9,809,874 | B2 | 11/2017 | Tanaka et al. | |
| 10,174,396 | B2 | 1/2019 | Takashima et al. | |
| 2015/0075680 | A1* | 3/2015 | Tanaka | C21D 1/26 148/333 |
| 2015/0101712 | A1* | 4/2015 | Futamura | C22C 38/06 148/661 |
| 2016/0369369 | A1 | 12/2016 | Takashima et al. | |
| 2018/0010220 | A1 | 1/2018 | Allain et al. | |
| 2018/0298462 | A1 | 10/2018 | Sano et al. | |
| 2019/0330721 | A1* | 10/2019 | Hayashi | C22C 38/44 |
| 2019/0360081 | A1 | 11/2019 | Minami et al. | |
| 2020/0063227 | A1 | 2/2020 | Yamazaki et al. | |
| 2021/0140007 | A1 | 5/2021 | Yamazaki et al. | |

FOREIGN PATENT DOCUMENTS

| | | | |
|---|---|---|---|
| CN | 102199722 | A | 9/2011 |
| CN | 105940134 | A | 9/2016 |
| CN | 107636184 | A | 1/2018 |
| CN | 110312814 | A | 10/2019 |
| EP | 3112488 | A1 | 1/2017 |
| EP | 3415656 | A1 | 12/2018 |

(Continued)

OTHER PUBLICATIONS

May 25, 2021, International Search Report issued in the International Patent Application No. PCT/JP2021/009856.
Nov. 4, 2024, Office Action issued by the Korean Intellectual Property Office in the corresponding Korean Patent Application No. 10-2022-7035571 with English language concise statement of relevance.
Jan. 4, 2024, Office Action issued by the China National Intellectual Property Administration in the corresponding Chinese Patent Application No. 202180016279.0 with English language concise statement of relevance.
Mar. 2, 2023, Office Action issued by the China National Intellectual Property Administration in the corresponding Chinese Patent Application No. 202180016279.0 with English language search report.

(Continued)

*Primary Examiner* — Jenny R Wu
(74) *Attorney, Agent, or Firm* — KENJA IP LAW PC

(57) ABSTRACT

Provided is a high strength steel sheet that has a tensile strength of 1180 MPa or more and a uniform elongation of 6% or more. The high strength steel sheet has a chemical composition that contains predetermined components with a MSC of 3.0 mass % to 4.2 mass %. The high strength steel sheet has a microstructure including upper bainite in an area fraction of 70% or more as a main phase, fresh martensite and retained austenite in a total area fraction of 7% to 30%, with the retained austenite having an area fraction of 2% or more. The high strength steel sheet has a mechanical property with a uniform elongation of 6% or more and a tensile strength of 1180 MPa or more.

5 Claims, No Drawings

(56) References Cited

FOREIGN PATENT DOCUMENTS

| | | | | |
|---|---|---|---|---|
| EP | 3584337 | A1 | | 12/2019 |
| JP | 2008156681 | A | | 7/2008 |
| JP | 2013072101 | A | | 4/2013 |
| JP | 2013216945 | A | | 10/2013 |
| JP | 2015025208 | A | | 2/2015 |
| JP | 2015218365 | A | | 12/2015 |
| JP | 2016194158 | A | | 11/2016 |
| JP | 2018131648 | A | | 8/2018 |
| JP | 2020204051 | A | | 12/2020 |
| KR | 20190007055 | A | * | 1/2019 |
| KR | 1020190109459 | A | | 9/2019 |
| WO | 2015115059 | A1 | | 8/2015 |
| WO | 2018150955 | A1 | | 8/2018 |
| WO | 2020026593 | A1 | | 2/2020 |
| WO | 2020065381 | A1 | | 4/2020 |

OTHER PUBLICATIONS

Aug. 22, 2023, Office Action issued by the China National Intellectual Property Administration in the corresponding Chinese Patent Application No. 202180016279.0 with English language search report.

Jan. 3, 2025, the Extended European Search Report issued by the European Patent Office in the corresponding European Patent Application No. 21771721.4.

Jul. 1, 2025, Office Action issued by the Korean Intellectual Property Office in the corresponding Korean Patent Application No. 10-2022-7035571 with English language concise statement of relevance.

* cited by examiner

HIGH STRENGTH STEEL SHEET AND METHOD OF PRODUCING SAME

TECHNICAL FIELD

This disclosure relates to a high strength steel sheet, and in particular to a high strength steel sheet suitable as a material for truck and passenger car frames, suspension parts, etc., having a tensile strength of 1180 MPa or more and a uniform elongation of 6% or more. This disclosure also relates to a method of producing the aforementioned high strength steel sheet.

BACKGROUND

Against a backdrop of automotive emission control aimed at curbing global warming, there is a need to reduce the weight of automobiles. It is effective to increase the strength of materials used for automotive parts in order to reduce the weight of automobiles, thus the application of hot-rolled high strength steel sheets is increasing year by year. In particular, a hot-rolled high strength steel sheet with a tensile strength of 1180 MPa or more is expected as a material that can dramatically improve the fuel efficiency of automobiles through the weight reduction.

On the other hand, increasing the tensile strength of a steel sheet reduces its ductility, which in turn deteriorates the press formability of this steel sheet. Automotive parts, particularly suspension and other undercarriage parts, require complex shapes to ensure the rigidity, thus the materials for automotive parts need to have high press formability, that is, ductility.

Therefore, to achieve higher strength in steel sheets without deteriorating the press formability, various technologies have been proposed.

For example, JP2008-156681A (PTL 1) proposes a hot-rolled steel sheet that has a predetermined chemical composition and a microstructure, which contains bainite in an area fraction of 90% or more and martensite and retained austenite in a total area fraction of 5% or less.

JP2015-025208A (PTL 2) proposes a high strength steel sheet that has a predetermined chemical composition and a microstructure, which includes the following (a) to (c) and has an amount of stacking faults in retained austenite of $10.0\times10_{-3}$ (nm/nm$^2$) or less:

(a) ferrite in a volume fraction of 5% to 35%,
(b) bainitic ferrite and/or tempered martensite in a total volume fraction of 50% or more, and
(c) mixed microstructure of fresh martensite and retained austenite (Martensite-Austenite Constituent, MA) in a volume fraction of 20% or less.

JP2016-194158A (PTL 3) proposes a hot-rolled steel sheet that has a predetermined chemical composition and a microstructure, which includes the following (a) to (c), with controlled average grain size and texture:

(a) low temperature transformation phase (retained austenite and tempered martensite) in an area fraction of 20% to 98%,
(b) ferrite in an area fraction of 2% to 80%, and
(c) residual microstructure in an area fraction of 0% to 10%.

CITATION LIST

Patent Literature

PTL 1: JP2008-156681A
PTL 2: JP2015-025208A
PTL 3: JP2016-194158A

SUMMARY

Technical Problem

However, the conventional techniques described in PTL 1 to PTL 3 have the following problems.

It is assumed that the technique proposed in PTL 1 can obtain a hot-rolled steel sheet having a tensile strength of 980 MPa or more. However, the actual tensile strength obtained in PTL 1 is 1088 MPa at a maximum. Thus, the technique described in PTL 1 cannot obtain a high strength of 1180 MPa or more.

In addition, it is assumed that the hot-rolled steel sheet has excellent formability in PTL 1. Here, in PTL 1, "elongation" is used as a measure of the formability. The "elongation" is also referred to as a total elongation (El) and represents an elongation at the point when a specimen fractures in a tensile test. In practice, however, necking occurs before the fracture occurs. When the necking occurs, the plate thickness becomes locally thin, resulting in product defects. Therefore, high total elongation alone is not sufficient to achieve excellent press formability.

Similarly, in PTL 2, the total elongation (El) is used as a measure of the formability. In PTL 2, the high strength steel sheet having a total elongation of 12% or more is obtained. However, as mentioned above, high total elongation alone is not sufficient to achieve excellent press formability.

In addition, the production of the high strength steel sheet in PTL 2 requires a heat treatment, in which heating and cooling are repeated several times, to the steel sheet after rolling, which is also problematic in terms of production cost.

On the other hand, PTL 3 refers a uniform elongation (u-El). However, in PTL 3, the product of a tensile strength TS and a uniform elongation u-El (TS×u-El) is used to evaluate only the balance between the strength and the ductility, not the value of the uniform elongation itself. As mentioned above, the strength and the press formability are contradictory properties. Thus, in order to obtain a high strength steel sheet with excellent strength and press formability, it is necessary to increase not the product of the tensile strength TS and the uniform elongation u-El but the individual values of TS and u-El.

Thus, the technique for obtaining a high strength steel sheet having the strength and the press formability at a high level had not yet been established actually.

This disclosure was made in consideration of the above situation, and it could be helpful to provide a high strength steel sheet having a tensile strength of 1180 MPa or more and a uniform elongation of 6% or more.

Solution to Problem

In order to solve the above problem, we created hypothetical stress-strain curves for steel sheets with a tensile strength of 1180 MPa or more and various yield stresses and uniform elongations and performed press forming simulation for suspension parts using the stress-strain curves. Then, based on the results of the simulation, we examined the characteristics of steel sheets necessary to obtain excellent press formability.

As a result, we found that in a steel sheet with a tensile strength of 1180 MPa or more, if the uniform elongation of 6% or more is ensured, reduction in sheet thickness during the press forming can be minimized to reduce press-forming failures.

Generally, in order to achieve a high strength of 1180 MPa or more, at least one of lower bainite and tempered martensite, which have harder microstructures, is used as a main phase of the microstructure of the steel sheet. However, these microstructures are inferior in uniform elongation. Therefore, we examined the optimum steel sheet microstructure to increase the uniform elongation of the steel sheet.

As a result, we found that a microstructure, in which the main phase is upper bainite, that contains appropriate amounts of fresh martensite and retained austenite can achieve a high strength of 1180 MPa or more and a uniform elongation of 6% or more.

We also found that, in order to obtain a microstructure containing appropriate amounts of fresh martensite and retained austenite, it is necessary to add Si, Mn, and Cr in a well-balanced manner.

Upper bainite here refers to an aggregate of lath-like ferrites with an orientation difference of less than 15°, which means a microstructure having Fe-based carbides and/or retained austenite between the lath-like ferrites (including a case where there are no Fe-based carbides and/or retained austenite between the lath-like ferrites). Unlike lamellar (layered) ferrite or polygonal ferrite in pearlite, lath-like ferrite has a lath-like shape and has a relatively high dislocation density inside, so the two can be distinguished using a scanning electron microscope (SEM) or a transmission electron microscope (TEM). When there is retained austenite between laths, only the lath-like ferrite portion is considered as upper bainite and is distinguished from retained austenite. Fresh martensite is martensite without Fe-based carbides. Fresh martensite and retained austenite have similar contrasts in the SEM, but they can be distinguished from one another using an Electron Backscatter Diffraction Patterns (EBSD) method.

This disclosure has been made based on the aforementioned discoveries and further studies, and primary features thereof are described below.

1. A high strength steel sheet comprising a chemical composition containing (consisting of), in mass %: C: 0.10% to 0.20%, Si: 0.7% to 1.4%, Mn: 2.3% to 4.0%, P: 0.10% or less, S: 0.03% or less, Al: 0.001% to 2.0%, N: 0.01% or less, O: 0.01% or less, and B: 0.0005% to 0.010%, with the balance being Fe and inevitable impurities, and with a MSC defined by the following formula (1) of 3.0 mass % to 4.2 mass %, the high strength steel sheet having a microstructure including: upper bainite in an area fraction of 70% or more as a main phase, and fresh martensite and retained austenite in a total area fraction of 7% to 30%, with the retained austenite having an area fraction of 2% or more, and the high strength steel sheet having a mechanical property with a uniform elongation of 6% or more and a tensile strength of 1180 MPa or more:

$$\text{MSC (mass \%)}=\text{Mn}+0.2\times\text{Si}+1.7\times\text{Cr}+2.5\times\text{Mo} \quad (1)$$

where each element symbol in the formula (1) represents a content, in mass %, of a corresponding element and is taken to be 0 when the corresponding element is not contained.

2. The high strength steel sheet according to 1., wherein the chemical composition further contains, in mass %, one or both of Cr: 1.0% or less and Mo: 1.0% or less.
3. The high strength steel sheet according to 1, or 2., wherein the chemical composition further contains, in mass %, at least one selected from the group consisting of Cu: 2.0% or less, Ni: 2.0% or less, Ti: 0.3% or less, Nb: 0.3% or less, and V: 0.3% or less.
4. The high strength steel sheet according to any one of 1. to 3., wherein the chemical composition further contains, in mass %, Sb: 0.005% to 0.020%.
5. The high strength steel sheet according to any one of 1. to 4., wherein the chemical composition further contains, in mass %, at least one selected from the group consisting of Ca: 0.01% or less, Mg: 0.01% or less, and REM: 0.01% or less.
6. A method of producing the high strength steel sheet according to any one of 1. to 5., the method comprising: heating a steel material having the chemical composition to a heating temperature of 1150° C. or more; subjecting the heated steel material to hot rolling to obtain a hot-rolled steel sheet under a set of conditions including a rolling finish temperature of (RC−50° C.) or more and (RC+150° C.) or less; cooling the hot-rolled steel sheet under a set of conditions including a time from the end of the hot rolling to the start of the cooling of 2.0 s or less, an average cooling rate of 5° C./s or more, and a cooling stop temperature of Trs or more and (Trs+250° C.) or less; coiling the hot-rolled steel sheet after the cooling under a set of conditions including a coiling temperature of Trs or more and (Trs+250° C.) or less; and cooling the hot-rolled steel sheet after the coiling to 100° C. or less at an average cooling rate of 20° C./s or less, wherein the RC is defined by the following formula (2) and the Trs is defined by the following formula (3):

$$\text{RC}(^\circ\text{C.})=800+100\times\text{C}+100\times\text{N}+10\times\text{Mn}+700\times\text{Ti}+5000\times\text{B}+10\times\text{Cr}+50\times\text{Mo}+2000\times\text{Nb}+150\times\text{V} \quad (2)$$

$$\text{Trs}(^\circ\text{C.})=500-450\times\text{C}-35\times\text{Mn}-15\times\text{Cr}-10\times\text{Ni}-20\times\text{Mo} \quad (3)$$

where each element symbol in the formulas (2) and (3) represents a content, in mass %, of a corresponding element and is taken to be 0 when the corresponding element is not contained.

Advantageous Effect

According to the present disclosure, a high strength steel sheet that has a tensile strength of 1180 MPa or more and a uniform elongation of 6% or more can be obtained. Despite its high tensile strength, the high strength steel sheet of this disclosure has excellent press formability and can be press-formed without forming failures such as necking and cracking. When the high strength steel sheet of this disclosure is applied to truck and passenger car components, it can reduce the weight of the automotive body while ensuring safety, which contributes to the reduction in environmental load.

DETAILED DESCRIPTION

Our high strength steel sheets and methods will be described in detail below. The following description merely presents examples of preferred embodiments of this disclosure, and this disclosure is not limited to these embodiments.

[Chemical Composition]

First, description will be made on reasons for limitations on the chemical composition of the high strength steel sheet of this disclosure. When contents are expressed in "%", this refers to "mass %" unless otherwise specified.

C: 0.10% to 0.20%

C is an element that has an effect of improving the strength of steel. C promotes the formation of bainite by improving quench hardenability, which contributes to higher strength. C also contributes to higher strength by increasing the strength of martensite. To obtain a tensile strength of 1180 MPa or more, the C content needs to be 0.10% or more. The C content is therefore 0.10% or more, preferably 0.12% or more, and more preferably 0.13% or more. On the other hand, if the C content exceeds 0.20%, the strength of martensite increases excessively and the difference in strength between upper bainite as the main phase, and fresh martensite and retained austenite increases, resulting in an impairment in uniform elongation. The C content is therefore 0.20% or less, preferably 0.18% or less, and more preferably 0.17% or less.

Si: 0.7% to 1.4%

Si acts to inhibit the formation of Fe-based carbides and suppresses the precipitation of cementite during upper bainite transformation. This distributes C to untransformed austenite. In the cooling after coiling, untransformed austenite becomes fresh martensite and/or retained austenite, which makes it possible to obtain the desired fresh martensite and retained austenite. To achieve these effects, the Si content needs to be 0.7% or more. The Si content is therefore 0.7% or more, and preferably 0.8% or more. On the other hand, Si is an element that forms subscale on the surface of the steel sheet during hot rolling. If the Si content exceeds 1.4%, the subscale becomes too thick and the surface roughness on the surface of the steel sheet after descaling becomes excessive, which deteriorates pre-coating processability of a hot-rolled steel sheet. Therefore, the Si content is 1.4% or less, preferably 1.3% or less, and more preferably 1.2% or less.

Mn: 2.3% to 4.0%

Mn stabilizes austenite and contributes to the formation of fresh martensite and/or retained austenite. To achieve this effect, the Mn content needs to be 2.3% or more. The Mn content is therefore 2.3% or more, and preferably 2.4% or more. On the other hand, if the Mn content exceeds 4.0%, fresh martensite and retained austenite are formed in excess to impair the uniform elongation. Therefore, the Mn content is 4.0% or less, preferably 3.6% or less, and more preferably 3.2% or less.

P: 0.10% or Less

P is an element that dissolves and forms a solute to contribute to higher strength of the steel. However, P is also an element that segregates at austenite grain boundaries during the hot rolling to cause slab cracking during the hot rolling. P also segregates at the grain boundaries to impair the uniform elongation. Therefore, the P content is preferably reduced as much as possible, but a P content of up to 0.10% is allowable. The P content is therefore 0.10% or less. On the other hand, the P content is desirably as low as possible. Accordingly, no lower limited is placed on the P content. The P content may be 0% or more or more than 0%. However, excessive reduction of the P content leads to an increase in production cost, thus the P content is preferably 0.0005% or more, and more preferably 0.001% or more.

S: 0.03% or Less

S combines with Ti or Mn to form a coarse sulfide. This sulfide accelerates the generation of voids to impair the uniform elongation. Therefore, the S content is preferably reduced as much as possible, but a S content of up to 0.03% is allowable. The S content is therefore 0.03% or less. On the other hand, the S content is desirably as low as possible. Accordingly, no lower limited is placed on the S content. The S content may be 0% or more or more than 0%. However, excessive reduction of the S content leads to an increase in production cost, thus the S content is preferably 0.0002% or more, and more preferably 0.0005% or more.

Al: 0.001% to 2.0%

Al acts as a deoxidizer and is an effective element for improving the cleanliness of the steel. Al, like Si, acts to inhibit the formation of Fe-based carbides and suppresses the precipitation of cementite during the upper bainite transformation. This allows Al to contribute to the formation of fresh martensite and/or retained austenite in the cooling after the coiling. If the Al content is less than 0.001%, its effect is not sufficient. Thus, the Al content is set to 0.001% or more. On the other hand, excessive addition of Al leads to an increase in oxide-based inclusion to impair the uniform elongation. The Al content is therefore 2.0% or less.

N: 0.01% or Less

N combines with a nitride-forming element to precipitate as a nitride and generally contributes to crystal grain refinement. However, N combines with Ti at high temperatures to form a coarse nitride. Accordingly, a N content of more than 0.01% causes an impairment in uniform elongation. Therefore, the N content is set to 0.01% or less. On the other hand, no lower limit is placed on the N content and may be 0%. However, in terms of increasing the effect of adding N, the N content is preferably 0.0005% or more, and more preferably 0.0010% or more.

O: 0.01% or Less

O is an element contained as an impurity in the steel, but an O content of 0.01% or less is allowable. Therefore, the 0 content is 0.01% or less, and preferably 0.005% or less. On the other hand, no lower limit is placed on the 0 content. The O content may be 0% or more or more than 0%. However, excessive reduction of the 0 content leads to an increase in production cost, thus the 0 content is preferably 0.0001% or more.

B: 0.0005% to 0.010%

B is an element that segregates at prior austenite grain boundaries and suppresses the formation of ferrite, which promotes the formation of upper bainite to contribute to the strength improvement of the steel sheet. To achieve these effects, the B content needs to be 0.0005% or more. Therefore, the B content is set to 0.0005% or more. On the other hand, if the B content exceeds 0.010%, the above-described effects are saturated. Therefore, the B content is set to 0.010% or less.

The high strength steel sheet according to one of the disclosed embodiments can have a chemical composition containing the above-described elements with the balance being Fe and inevitable impurities.

The inevitable impurities include, for example, Zr, Co, Sn, Zn, and W. When the chemical composition contains at least one selected from the group consisting of Zr, Co, Sn, Zn, and W as inevitable impurities, the total content of these elements is preferably 0.5% or less.

The chemical composition of the high strength steel sheet in another embodiment of this disclosure can further optionally contain at least one of the following elements.

Cr: 1.0% or Less

Cr is a carbide-forming element and has an effect that segregates at the interface between upper bainite and untransformed austenite during the upper bainitic transformation after the hot-rolled steel sheet is rolled, reducing the driving force of the bainitic transformation and stopping the upper bainitic transformation. The untransformed austenite remaining due to the stop of the transformation to upper bainite becomes fresh martensite and/or retained austenite by the cooling after the coiling. Therefore, when Cr is added, Cr also contributes to the formation of fresh martensite and retained austenite in desired area fractions. However, Cr is an element that deteriorates corrosion resistance and pre-coating processability. Accordingly, when Cr is added, the Cr content is set to 1.0% or less.

Mo: 1.0% or Less

Mo promotes the formation of bainite through the improvement of the quench hardenability to contribute to the strength improvement of the steel sheet. Mo, like Cr, is a carbide-forming element and has an effect that segregates at the interface between upper bainite and untransformed austenite during the upper bainitic transformation after the hot-rolled steel sheet is rolled, reducing the transformation driving force of bainite and contributing to the formation of fresh martensite and retained austenite after the coiling and the cooling. However, if the Mo content exceeds 1.0%, fresh martensite and retained austenite are excessively formed to impair the uniform elongation. Therefore, when Mo is added, the Mo content is set to 1.0% or less.

The chemical composition of the high strength steel sheet in another embodiment of this disclosure can further optionally contain at least one of the following elements.

Cu: 2.0% or Less

Cu is an element that dissolves and forms a solute to contribute to higher strength of the steel. Cu also promotes the formation of bainite through the improvement of the quench hardenability to contribute to strength improvement. However, if the Cu content exceeds 2.0%, the surface texture of the hot-rolled steel sheet degrades to deteriorate the fatigue resistance of the hot-rolled steel sheet. Therefore, when Cu is added, the Cu content is set to 2.0% or less.

Ni: 2.0% or Less

Ni is an element that dissolves and forms a solute to contribute to higher strength of the steel. Ni also promotes the formation of bainite through the improvement of the quench hardenability to contribute to strength improvement. However, if the Ni content exceeds 2.0%, fresh martensite and retained austenite increase excessively to degrade the ductility of the hot-rolled steel sheet. Therefore, when Ni is added, the Ni content is set to 2.0% or less.

Ti: 0.3% or Less

Ti is an element that has an effect of increasing the strength of the steel sheet by strengthening by precipitation or solid solution strengthening. Ti forms nitrides in the high temperature region of austenite. This suppresses the precipitation of BN to make B be in a solid solution state. Accordingly, when Ti is added, Ti also contributes to ensuring the quench hardenability necessary for the formation of upper bainite, which increases the strength. However, if the Ti content exceeds 0.3%, a large amount of Ti nitrides are formed to impair the uniform elongation. Therefore, when Ti is added, the Ti content is set to 0.3% or less.

Nb: 0.3% or Less

Nb is an element that has an effect of increasing the strength of the steel sheet by strengthening by precipitation or solid solution strengthening. Nb, like Ti, also raises the recrystallization temperature of austenite during the hot rolling, allowing the rolling in the austenite unrecrystallized region and contributing to grain size refinement of upper bainite and an increase in the volume fraction of fresh martensite and retained austenite. Nb, like Cr, is a carbide-forming element and has an effect that segregates at the interface between upper bainite and untransformed austenite during the upper bainitic transformation after the hot-rolled steel sheet is rolled, reducing the transformation driving force of bainite and stopping the upper bainite transformation while leaving untransformed austenite. Untransformed austenite is then cooled to become fresh martensite and/or retained austenite. Therefore, when Nb is added, Nb also contributes to the formation of fresh martensite and retained austenite in desired area fractions. However, if the Nb content exceeds 0.3%, fresh martensite and retained austenite increase excessively to impair the uniform elongation. Therefore, when Nb is added, the Nb content is set to 0.3% or less.

V: 0.3% or Less

V is an element that has an effect of increasing the strength of the steel sheet through strengthening by precipitation and solid solution strengthening. V, like Ti, raises the recrystallization temperature of austenite during the hot rolling, allowing the rolling in the austenite unrecrystallized region and contributing to the grain size refinement of upper bainite. V, like Cr, is a carbide-forming element and has an effect that segregates at the interface between upper bainite and untransformed austenite during the upper bainitic transformation after the hot-rolled steel sheet is rolled, reducing the transformation driving force of bainite and stopping the upper bainite transformation while leaving untransformed austenite. Untransformed austenite is then cooled to become fresh martensite and/or retained austenite. Therefore, when V is added, V also contributes to the formation of fresh martensite and retained austenite in desired area fractions. However, if the V content exceeds 0.3%, fresh martensite and retained austenite increase excessively to impair the uniform elongation. Therefore, when V is added, the V content is set to 0.3% or less.

The chemical composition of the high strength steel sheet in another embodiment of this disclosure can further optionally contain the following elements.

Sb: 0.005% to 0.020%

Sb is an element that has an effect of suppressing nitriding of the surface of steel material (slab) when it is heated. The addition of Sb can suppress the precipitation of BN on the surface layer of the steel material. As a result, the remaining solute B contributes to ensuring the quench hardenability necessary for the formation of bainite and thereby increasing the strength of the steel sheet. When Sb is added, to obtain the effect, the Sb content is set to 0.005% or more. On the other hand, if the Sb content exceeds 0.020%, the toughness of the steel decreases to possibly cause slab cracking and hot rolling cracking. Therefore, when Sb is added, the Sb content is set to 0.020% or less.

The chemical composition of the high strength steel sheet in another embodiment of this disclosure can further optionally contain at least one of the following elements. The following elements contribute to further improvement of properties such as the press formability.

Ca: 0.01% or Less

Ca controls the shape of oxide and sulfide-type inclusions and contributes to the suppression of cracking on the sheared end surface of the steel sheet and further improvement of bending workability. However, if the Ca content exceeds 0.01%, Ca-based inclusions increase to deteriorate the cleanliness of the steel, which may in turn cause the sheared end surface cracking or bending cracking. Therefore, when Ca is added, the Ca content is set to 0.01% or less.

Mg: 0.01% or Less

Mg, like Ca, controls the shape of oxide and sulfide-type inclusions and contributes to the suppression of cracking on the sheared end surface of the steel sheet and further improvement of the bending workability. However, if the Mg content exceeds 0.01%, the cleanliness of the steel deteriorates, which may in turn cause the sheared end surface cracking or the bending cracking. Therefore, when Mg is added, the Mg content is set to 0.01% or less.

REM: 0.01% or Less

Rare earth metal (REM), like Ca, controls the shape of oxide and sulfide-type inclusions and contributes to the suppression of cracking on the sheared end surface of the steel sheet and further improvement of the bending workability. However, if the REM content exceeds 0.01%, the cleanliness of the steel deteriorates, which may in turn cause the sheared end surface cracking or the bending cracking. Therefore, when REM is added, the REM content is set to 0.01% or less.

No lower limits are placed on the contents of Cr, Mo, Cu, Ni, Ti, Nb, V, Ca, Mg, and REM. The contents of Cr, Mo, Cu, Ni, Ti, Nb, V, Ca, Mg, and REM may be 0% or more.

MSC: 3.0 Mass % to 4.2 Mass %

In order to obtain high uniform elongation while maintaining a high strength of 1180 MPa or more, as described below, it is necessary to control the area fractions of fresh martensite and retained austenite within an appropriate range. To control the area fractions of fresh martensite and retained austenite, the addition balance of Mn, Si, Cr (if added), and Mo (if added) is important. Specifically, a MSC value defined by Formula (1) below needs to be 3.0 mass % to 4.2 mass %. In a high strength steel sheet having a tensile strength of 1180 MPa or more, if the MSC value is outside the range, a uniform elongation of 6% or more cannot be obtained. MSC is preferably 3.1 mass % or more. MSC is preferably 3.7 mass % or less, and more preferably 3.5 mass % or less.

$$\text{MSC (mass \%)} = \text{Mn} + 0.2\times\text{Si} + 1.7\times\text{Cr} + 2.5\times\text{Mo} \quad (1)$$

where each element symbol in Formula (1) indicates a content, in mass %, of a corresponding element and is taken to be 0 if the corresponding element is not contained.

[Microstructure]

Next, description will be made on reasons for limitations on the microstructure of the high strength steel sheet of this disclosure.

The high strength steel sheet of this disclosure has a microstructure containing (1) upper bainite in an area fraction of 70% or more as a main phase, and (2) fresh martensite and retained austenite in a total area fraction of 7% to 30%. The area fraction of the retained austenite is 2% or more. When the percentage of the microstructure is expressed in "%", this refers to the area fraction unless otherwise specified.

Upper Bainite: 70% or More

The microstructure of the high strength steel sheet of this disclosure contains upper bainite as the main phase. If the area fraction of upper bainite is less than 70%, a tensile strength of 1180 MPa or more and a uniform elongation of 6% or more cannot be achieved. Therefore, the area fraction of upper bainite is 70% or more, and preferably 80% or more. No upper limit is placed on the area fraction of upper bainite. However, the total area fraction of fresh martensite and retained austenite is 7% or more. Thus, the area fraction of upper bainite may be 93% or less.

Fresh Martensite and Retained Austenite: 7% to 30%.

The microstructure of the high strength steel sheet of this disclosure contains fresh martensite and retained austenite. If the total area fraction of fresh martensite and retained austenite is less than 7%, a tensile strength of 1180 MPa or more and a uniform elongation of 6% or more cannot be achieved. Therefore, the total area fraction of fresh martensite and retained austenite is set to 7% or more. On the other hand, if the total area fraction exceeds 30%, the coalescence growth of voids formed at the interface between fresh martensite and retained austenite, and the main phase is accelerated, which impairs the uniform elongation. The total area fraction is therefore 30% or less, preferably 20% or less, and more preferably 16% or less.

Retained Austenite: 2% or More

Fresh martensite has an effect that improves the uniform elongation by promoting work hardening to delay the onset of plastic instability. However, to obtain a uniform elongation of 6% or more in the high strength steel sheet with a tensile strength of 1180 MPa or more, fresh martensite alone is not sufficient and retained austenite needs to be contained 2% or more. Therefore, the area fraction of retained austenite is set to 2% or more.

That is, a tensile strength of 1180 MPa or more and a uniform elongation of 6% or more can only be achieved by combining the work hardening ability of fresh martensite and the strain dispersing ability of retained austenite through the transformation induced plasticity (TRIP) effect.

The above-described microstructure can further contain any microstructures other than upper bainite, fresh martensite, and retained austenite (hereinafter referred to as "other microstructures"). However, from the viewpoint of enhancing the effect of microstructure control, the total area fraction of the other microstructures is preferably set to 3% or less. In other words, the total area fraction of upper bainite, fresh martensite, and retained austenite in the above-described microstructure is preferably set to 97% or more. The other microstructures include, for example, cementite, pearlite, tempered martensite, and lower bainite.

Therefore, the high strength steel sheets in one of the disclosed embodiments can have a microstructure containing:

(1) upper bainite as the main phase: 70% to 93%,
(2) fresh martensite and retained austenite: 7% to 30% in total, and
(3) microstructures other than upper bainite, fresh martensite, and retained austenite: 0% to 3% in total; and the area fraction of the retained austenite is 2% or more.

[Mechanical Properties]

Uniform elongation: 6% or more

Tensile strength: 1180 MPa or more

As mentioned above, the high strength steel sheet of this disclosure has a tensile strength of 1180 MPa or more and a uniform elongation of 6% or more. Therefore, despite its high tensile strength, the high strength steel sheet of this disclosure has excellent press formability and can be press-formed without forming failures such as necking and cracking. No upper limit is placed on the tensile strength. However, an excessive increase in tensile strength makes it difficult to ensure a uniform elongation of 6% or more. Therefore, the tensile strength is preferably 1500 MPa or less, and more preferably 1400 MPa or less. No upper limit is also placed on the uniform elongation. However, an excessive increase in uniform elongation makes it difficult to ensure a tensile strength of 1180 MPa or more. Therefore, the uniform elongation is preferably 10% or less, and more preferably 9.5% or less.

[Production Method]

The following describes a method of producing a high strength steel sheet according to one of the disclosed embodiments. Unless otherwise specified, temperatures in the following descriptions represent the surface temperature of the object (steel material or steel sheet).

The high strength steel sheet of this disclosure can be produced by sequentially applying the following processes (1) to (5) to the steel material. The following describes each step.

(1) Heating
(2) Hot rolling
(3) Cooling (first cooling)
(4) Coiling
(5) Cooling (second cooling)

(Steel Material)

Any steel material having the aforementioned chemical composition can be used. The chemical composition of the finally obtained steel plate is the same as the chemical composition of the used steel material. As the steel material, for example, a steel slab can be used.

The method of producing the steel material is not limited. For example, molten steel having the above-described chemical composition can be melted in a known method such as a converter to obtain the steel material by a casting method such as continuous casting. Methods other than the continuous casting can also be used, such as the ingot casting-blooming method. Scrap may also be used as raw material. The steel material may be produced by a method such as continuous casting and then directly provided to the next heating process, or the steel material may be cooled to be warm or cold pieces and then provided to the heating process.

(Heating)

Heating Temperature: 1150° C. Or More

First, the steel material is heated to a heating temperature of 1150° C. or more. Usually, most of carbonitride-forming elements, such as Ti, are present as coarse carbonitrides in the steel material. The presence of such coarse and non-uniform precipitates generally deteriorates the properties (e.g., sheared end surface cracking resistance, bending workability, burring formability, etc.) required of high strength steel sheets for truck and passenger car parts. Therefore, it is necessary to heat the steel material prior to the hot rolling to cause coarse precipitates to dissolve and form a solute.

Specifically, to cause coarse precipitates to sufficiently dissolve and form a solute, the heating temperature of the steel material need to be 1150° C. or more. The heating temperature of the steel material is therefore 1150° C. or more, preferably 1180° C. or more, and more preferably 1200° C. or more. On the other hand, excessively high heating temperature of the steel material leads to slab defects and a reduction in yield rate due to scale-off. Therefore, from the viewpoint of improving the yield rate, the heating temperature of the steel material is preferably set to 1350° C. or less. The heating temperature is preferably 1300° C. or less, and more preferably 1280° C. or less.

In the heating, from the viewpoint of uniform temperature of the steel material, it is preferable to raise the temperature of the steel material to the heating temperature and then hold it at this heating temperature. The time to hold the steel material at the heating temperature (holding time) is not particularly limited. However, from the viewpoint of improving the uniformity of temperature of the steel material, the holding time is preferable set to 1800 seconds or more. On the other hand, if the holding time exceeds 10000 seconds, the amount of scale generation increases. As a result, scale biting, etc. becomes more likely to occur during the subsequent hot rolling, which reduces the yield rate due to surface defects. Therefore, the holding time is preferably 10000 seconds or less, and preferably 8000 seconds or less.

(Hot Rolling)

Next, the heated steel material is hot-rolled to obtain a hot-rolled steel plate. The hot rolling may include rough rolling and finish rolling. When the rough rolling is performed, the conditions are not particularly limited. After the rough rolling, high-pressure water descaling is preferably performed prior to the finish rolling to remove surface scale. The descaling may be performed between stands during the finish rolling.

Rolling finish temperature: (RC−50° C.) or more, (RC+150° C.) or less The hot rolling is performed under a set of conditions including a rolling finish temperature of (RC−50° C.) or more, and a rolling finish temperature of (RC+150° C.) or less. If the rolling finish temperature is less than (RC−50° C.), bainite transformation will occur from austenite in a high dislocation density state. The upper bainite transformed from the austenite in a high dislocation density state has high dislocation density and poor ductility, which impairs the uniform elongation. The uniform elongation is also impaired when the rolling finish temperature is low, and the rolling is performed at a dual phase region temperature of ferrite and austenite. Therefore, the rolling finish temperature is set to (RC−50° C.) or more. On the other hand, if the rolling finish temperature is higher than (RC+150° C.), austenite grains become coarser and the average grain size of upper bainite becomes larger, which reduces the strength. Fresh martensite and retained austenite also become coarser, resulting in an impairment in uniform elongation. Therefore, the rolling finish temperature is set to (RC+150° C.) or less.

RC is the lower limit of austenite recrystallization temperature estimated from the chemical composition and defined by Formula (2) below.

$$RC(^\circ C.)=800+100\times C+100\times N+10\times Mn+700\times Ti+5000\times B+10\times Cr+50\times Mo+2000\times Nb+150\times V \quad (2)$$

where each element symbol in Formula (2) indicates a content, in mass %, of a corresponding element and is taken to be 0 when the corresponding element is not contained.

(Cooling)

Cooling Start Time: 2.0 s or Less

Next, the hot-rolled steel sheet is cooled (first cooling). In this case, the time from the end of the hot rolling to the start of the cooling (cooling start time) is set to 2.0 s or less. If the cooling start time exceeds 2.0 s, grain growth of austenite grains occurs and a tensile strength of 1180 MPa or more cannot be ensured. The cooling start time is preferably set to 1.5 s or less. On the other hand, a shorter cooling start time is preferable. Thus, the cooling start time may be 0 s or more.

Average Cooling Rate: 5° C./s or More

If an average cooling rate in the cooling is less than 5° C./s, ferrite transformation occurs prior to the upper bainite transformation, and upper bainite in a desired area fraction cannot be obtained. Therefore, the average cooling rate is 5° C./s or more, preferably 20° C./s or more, and more preferably 50° C./s or more. On the other hand, no upper limit is placed on the average cooling rate. However, an excessive increase in average cooling rate makes it difficult to control a cooling stop temperature. Therefore, the average cooling rate is preferably 200° C./s or less, and more preferably 150° C./s or less. The average cooling rate is specified based on an average cooling rate at the surface of the steel sheet.

In the cooling, forced cooling may be performed to achieve the above-described average cooling rate. The method of the cooling is not particularly limited, but it is preferably performed, for example, by water cooling.

Cooling stop temperature: Trs or more, (Trs+250° C.) or less If the cooling stop temperature is less than Trs, the microstructure becomes tempered martensite or lower bainite. Tempered martensite and lower bainite are both high-strength microstructures, but their uniform elongations are significantly low. Therefore, the cooling stop temperature is set to Trs or more. On the other hand, if the cooling stop temperature is higher than (Trs+250° C.), ferrite is formed and a tensile strength of 1180 MPa cannot be obtained. Therefore, the cooling stop temperature is set to (Trs+250° C.) or less.

Trs is defined by Formula (3) below.

$$Trs(^\circ C.)=500-450\times C-35\times Mn-15\times Cr-10\times Ni-20\times Mo \quad (3)$$

where each element symbol in Formula (3) indicates a content, in mass %, of a corresponding element and is taken to be 0 when the corresponding element is not contained.

(Coiling)

Coiling Temperature: Trs or More, (Trs+250° C.) or Less

Next, the hot-rolled steel sheet after the cooling is coiled under a set of conditions including a coiling temperature of Trs or higher, and a coiling temperature of (Trs+250° C.) or less. If the coiling temperature is less than Trs, martensite transformation or lower bainite transformation proceeds after the coiling, and desired fresh martensite and retained austenite cannot be obtained. Therefore, the coiling temperature is set to Trs or more. On the other hand, if the coiling temperature is higher than (Trs+250° C.), ferrite is formed and a tensile strength of 1180 MPa cannot be obtained. Therefore, the coiling temperature is set to (Trs+250° C.) or less.

(Cooling)

Average Cooling Rate: 20° C./s or Less

After the coiling, cooling is further performed to 100° C. or less at an average cooling rate of 20° C./s or less (second cooling). The average cooling rate affects the formation of fresh martensite and retained austenite. If the average cooling rate exceeds 20° C./s, most of untransformed austenite transforms to martensite, and desired retained austenite cannot be obtained to impair the uniform elongation. Therefore, the average cooling rate is 20° C./s or less, preferably 2° C./s or less, and more preferably 0.02° C./s or less. On the other hand, no lower limit is placed on the above-described average cooling rate. However, the average cooling rate is preferably 0.0001° C./s or more.

The cooling can be performed to any temperature of 100° C. or less. However, the cooling is preferably performed to about 10° C. to 30° C. (e.g., room temperature). The cooling can be performed in any form, for example, in a coiled state.

The high strength steel sheet of this disclosure can be produced according to the above procedures. After the coiling and the subsequent cooling, temper rolling may be applied according to the conventional method, or acid cleaning may be applied to remove the scale formed on the surface.

EXAMPLES

Molten steels with the compositions presented in Table 1 were prepared by steelmaking using a converter and subjected to continuous casting to produce steel slabs as steel materials. Each obtained steel materials was heated to a corresponding heating temperature presented in Table 2, and then the steel material after the heating was subjected to hot rolling including the rough rolling and the finish rolling to obtain a hot-rolled steel sheet. Each rolling finish temperature in the hot rolling is presented in Table 2.

Next, each obtained hot-rolled steel sheet was cooled under a set of conditions including a corresponding average cooling rate and a corresponding cooling stop temperature presented in Table 2. Each hot-rolled steel sheet after the cooling was coiled at a corresponding coiling temperature presented in Table 2, and the coiled steel sheet was cooled at a corresponding average cooling rate presented in Table 2 to obtain a high strength steel sheet. After the cooling, skin pass rolling and acid cleaning were performed as post-treatment. The acid cleaning was performed at a temperature of 85° C. using an aqueous hydrochloric acid solution with a concentration of 10 mass %.

Test specimens were taken from each obtained high strength steel sheet, and the microstructure and the mechanical properties were evaluated according to the procedure described below.

(Microstructure)

From each obtained high strength steel sheet, a test specimen for microstructure observation was taken so that a cross section in the sheet thickness direction cut in parallel with the rolling direction was an observation plane. The surface of the obtained specimen was polished. Further, the microstructure was exposed by corroding the surface using a corrosion solution (3 mass % nital solution).

Next, the surface of the specimen at a position of ¼ of the sheet thickness was imaged in ten fields of view at 5000-fold magnification using a scanning electron microscope (SEM) to obtain a SEM image of the microstructure. The SEM image was analyzed by image processing to quantify the area fractions of upper bainite (UB), polygonal ferrite (F), and tempered martensite (TM). Fresh martensite (M) and retained austenite (7) are difficult to distinguish from one another by the SEM. Thus, they were identified using the Electron Backscatter Diffraction Patterns (EBSD) method to obtain the respective area fractions. The area fractions of each measured microstructure are presented in Table 3. The total area fractions of fresh martensite and retained austenite (M+γ) were also listed in Table 3.

(Tensile Test)

From each obtained high strength steel sheet, a JIS No. 5 test specimen (gage length (GL): 50 mm) was taken so that the tensile direction is perpendicular to the rolling direction. The test specimen was subjected to the tensile test in accordance with the provisions of JIS Z 2241 to obtain the yield stress (yield point, YP), the tensile strength (TS), the total elongation (El) and the uniform elongation (u-El). The tensile test was performed twice for each high strength steel sheet, and the average of the obtained measurements was presented in Table 3 as the mechanical properties of the corresponding high strength steel sheet. In this disclosure, a TS of 1180 MPa or more was evaluated as high strength, and a uniform elongation of 6% or more was evaluated as good press formability.

TABLE 1

| Steel sample | Chemical composition (mass %) * | | | | | | | | |
|---|---|---|---|---|---|---|---|---|---|
| ID | C | Si | Mn | P | S | Al | N | O | B |
| A | 0.114 | 1.20 | 2.90 | 0.015 | 0.0010 | 0.042 | 0.0050 | 0.0013 | 0.0020 |
| B | 0.183 | 0.90 | 3.31 | 0.010 | 0.0008 | 0.040 | 0.0041 | 0.0025 | 0.0015 |

TABLE 1-continued

| | | | | | | | | | |
|---|---|---|---|---|---|---|---|---|---|
| C | 0.142 | 0.75 | 3.11 | 0.011 | 0.0007 | 0.061 | 0.0056 | 0.0009 | 0.0015 |
| D | 0.161 | 1.26 | 3.21 | 0.010 | 0.0009 | 0.050 | 0.0045 | 0.0020 | 0.0013 |
| E | 0.172 | 1.40 | 2.41 | 0.015 | 0.0013 | 0.038 | 0.0035 | 0.0011 | 0.0015 |
| F | 0.122 | 0.73 | 3.98 | 0.015 | 0.0010 | 0.045 | 0.0045 | 0.0020 | 0.0018 |
| G | 0.134 | 1.08 | 2.77 | 0.005 | 0.0006 | 0.040 | 0.0035 | 0.0016 | 0.0025 |
| H | 0.144 | 0.89 | 2.47 | 0.009 | 0.0017 | 1.910 | 0.0055 | 0.0012 | 0.0006 |
| I | 0.139 | 0.96 | 2.96 | 0.011 | 0.0009 | 0.050 | 0.0040 | 0.0009 | 0.0017 |
| J | 0.142 | 0.88 | 2.55 | 0.021 | 0.0006 | 0.037 | 0.0029 | 0.0007 | 0.0020 |
| K | 0.118 | 0.72 | 2.43 | 0.012 | 0.0013 | 0.048 | 0.0036 | 0.0011 | 0.0032 |
| L | 0.163 | 1.06 | 3.68 | 0.008 | 0.0006 | 0.040 | 0.0028 | 0.0023 | 0.0095 |
| M | 0.145 | 0.99 | 2.96 | 0.014 | 0.0023 | 0.047 | 0.0038 | 0.0010 | 0.0010 |
| N | 0.122 | 1.15 | 2.88 | 0.013 | 0.0009 | 0.043 | 0.0040 | 0.0010 | 0.0015 |
| O | 0.108 | 1.18 | 2.77 | 0.019 | 0.0018 | 0.041 | 0.0098 | 0.0013 | 0.0007 |
| P | 0.125 | 1.25 | 2.82 | 0.034 | 0.0008 | 0.041 | 0.0041 | 0.0012 | 0.0009 |
| a | 0.061 | 1.05 | 3.20 | 0.029 | 0.0012 | 0.031 | 0.0044 | 0.0021 | 0.0017 |
| b | 0.212 | 0.99 | 3.08 | 0.012 | 0.0039 | 0.028 | 0.0035 | 0.0024 | 0.0016 |
| c | 0.145 | 0.35 | 3.66 | 0.025 | 0.0031 | 0.045 | 0.0055 | 0.0011 | 0.0019 |
| d | 0.138 | 1.36 | 2.81 | 0.013 | 0.0012 | 0.052 | 0.0037 | 0.0012 | 0.0003 |
| e | 0.142 | 1.38 | 2.05 | 0.020 | 0.0015 | 0.065 | 0.0042 | 0.0025 | 0.0019 |
| f | 0.133 | 0.71 | 4.05 | 0.010 | 0.0015 | 0.047 | 0.0062 | 0.0011 | 0.0014 |
| g | 0.149 | 0.88 | 2.36 | 0.016 | 0.0017 | 0.055 | 0.0038 | 0.0011 | 0.0019 |
| h | 0.126 | 1.30 | 3.25 | 0.016 | 0.0015 | 0.045 | 0.0042 | 0.0009 | 0.0026 |
| l | 0.118 | 1.26 | 3.05 | 0.009 | 0.0009 | 0.051 | 0.0036 | 0.0017 | 0.0020 |
| j | 0.140 | 0.92 | 2.95 | 0.108 | 0.0014 | 0.042 | 0.0041 | 0.0021 | 0.0008 |

| Steel sample ID | Chemical composition (mass %) * Others | MSC (mass %) | RC (° C.) | RC − 50 (° C.) | RC+ 150 (° C.) | Trs (° C.) | Trs + 250 (° C.) | Remarks |
|---|---|---|---|---|---|---|---|---|
| A | — | 3.14 | 851 | 801 | 1001 | 347 | 597 | Conforming steel |
| B | — | 3.49 | 859 | 809 | 1009 | 302 | 552 | Conforming steel |
| C | — | 3.26 | 853 | 803 | 1003 | 327 | 577 | Conforming steel |
| D | Sb: 0.007 | 3.46 | 855 | 805 | 1005 | 315 | 565 | Conforming steel |
| E | Cr: 0.20, Ca: 0.0035 | 3.04 | 851 | 801 | 1001 | 335 | 585 | Conforming steel |
| F | — | 4.13 | 861 | 811 | 1011 | 306 | 556 | Conforming steel |
| G | Cr: 0.30 | 3.51 | 857 | 807 | 1007 | 338 | 588 | Conforming steel |
| H | Cr: 0.80, Sb: 0.019 | 4.05 | 851 | 801 | 1001 | 337 | 587 | Conforming steel |
| I | Mo: 0.23 | 3.73 | 864 | 814 | 1014 | 329 | 579 | Conforming steel |
| J | Mo: 0.41 | 3.75 | 870 | 820 | 1020 | 339 | 589 | Conforming steel |
| K | Mo: 0.62 | 4.12 | 883 | 833 | 1033 | 349 | 599 | Conforming steel |
| L | Cu: 1.02 | 3.89 | 901 | 851 | 1051 | 298 | 548 | Conforming steel |
| M | Ni: 0.48, Mg: 0.0022 | 3.16 | 849 | 799 | 999 | 326 | 576 | Conforming steel |
| N | Ti: 0.021, REM: 0.0016 | 3.11 | 864 | 814 | 1014 | 344 | 594 | Conforming steel |
| O | Ti: 0.082, Nb: 0.037 | 3.01 | 974 | 924 | 1124 | 354 | 604 | Conforming steel |
| P | Ti: 0.125, V: 0.013 | 3.07 | 935 | 885 | 1085 | 345 | 595 | Conforming steel |
| a | — | 3.41 | 847 | 797 | 997 | 361 | 611 | Comparative steel |
| b | — | 3.28 | 860 | 810 | 1010 | 297 | 547 | Comparative steel |
| c | — | 3.73 | 861 | 811 | 1011 | 307 | 557 | Comparative steel |
| d | — | 3.08 | 844 | 794 | 994 | 340 | 590 | Comparative steel |
| e | Cr: 0.40 | 3.03 | 849 | 799 | 999 | 358 | 608 | Comparative steel |
| f | — | 4.19 | 861 | 811 | 1011 | 298 | 548 | Comparative steel |
| g | Cr: 0.18 | 2.85 | 850 | 800 | 1000 | 348 | 598 | Comparative steel |
| h | Cr: 0.47 | 4.33 | 863 | 813 | 1013 | 323 | 573 | Comparative steel |
| l | Cr: 1.10 | 5.23 | 864 | 814 | 1014 | 324 | 574 | Comparative steel |
| j | Ti: 0.350 | 3.13 | 1072 | 1022 | 1222 | 334 | 584 | Comparative steel |

* The balance is composed of Fe and inevitable impurity.

TABLE 2

| | | Production conditions | | | | | | | | |
|---|---|---|---|---|---|---|---|---|---|---|
| | | | Hot rolling | Cooling | | | | Cooling | | |
| No. | Steel sample ID | Heating Heating temperature (° C.) | Rolling finish temperature (° C.) | Cooling Start time (s) | Average Cooling rate (C/s) | Cooling Stop temperature (° C.) | Coiling Coiling temperature (° C.) | Average Cooling rate (° C./s) | Cooling Stop temperature (° C.) | Remarks |
| 1 | A | 1250 | 880 | 0.6 | 60 | 435 | 445 | 5 | 50 | Example |
| 2 | A | 1210 | 960 | 2.0 | 45 | 470 | 460 | 8 | 55 | Example |
| 3 | A | 1200 | 910 | 0.5 | 80 | 330 | 375 | 4 | 35 | Example |
| 4 | A | 1240 | 920 | 0.7 | 55 | 570 | 550 | 6 | 80 | Example |
| 5 | B | 1230 | 915 | 0.9 | 75 | 455 | 470 | 11 | 45 | Example |
| 6 | C | 1220 | 895 | 1.1 | 37 | 530 | 520 | 17 | 75 | Example |
| 7 | D | 1220 | 905 | 0.6 | 92 | 425 | 445 | 5 | 40 | Example |
| 8 | E | 1270 | 885 | 0.8 | 75 | 500 | 490 | 7 | 80 | Example |
| 9 | F | 1200 | 915 | 0.7 | 62 | 360 | 390 | 3 | 40 | Example |

TABLE 2-continued

| | | Production conditions | | | | | | | | |
|---|---|---|---|---|---|---|---|---|---|---|
| | | | Hot rolling | Cooling | | | | Cooling | | |
| No. | Steel sample ID | Heating Heating temperature (° C.) | Rolling finish temperature (° C.) | Cooling Start time (s) | Average Cooling rate (C/s) | Cooling Stop temperature (° C.) | Coiling Coiling temperature (° C.) | Average Cooling rate (° C./s) | Cooling Stop temperature (° C.) | Remarks |
| 10 | G | 1250 | 860 | 0.4 | 55 | 410 | 420 | 3 | 50 | Example |
| 11 | G | 1230 | 975 | 1.1 | 38 | 405 | 430 | 7 | 70 | Example |
| 12 | G | 1260 | 920 | 1.0 | 32 | 310 | 345 | 4 | 85 | Example |
| 13 | G | 1240 | 925 | 0.7 | 95 | 580 | 570 | 8 | 75 | Example |
| 14 | H | 1230 | 905 | 1.8 | 47 | 420 | 440 | 6 | 70 | Example |
| 15 | I | 1250 | 890 | 1.3 | 38 | 475 | 490 | 4 | 55 | Example |
| 16 | J | 1240 | 920 | 0.6 | 46 | 520 | 510 | 9 | 70 | Example |
| 17 | K | 1235 | 900 | 0.8 | 58 | 405 | 430 | 5 | 50 | Example |
| 18 | L | 1210 | 960 | 1.0 | 92 | 385 | 410 | 6 | 55 | Example |
| 19 | M | 1235 | 910 | 0.5 | 62 | 500 | 495 | 7 | 80 | Example |
| 20 | N | 1220 | 900 | 0.7 | 38 | 410 | 430 | 7 | 55 | Example |
| 21 | O | 1300 | 980 | 0.9 | 77 | 525 | 510 | 4 | 35 | Example |
| 22 | P | 1270 | 930 | 1.3 | 64 | 540 | 530 | 9 | 75 | Example |
| 23 | a | 1250 | 930 | 0.6 | 88 | 400 | 420 | 10 | 35 | Comparative Example |
| 24 | b | 1220 | 910 | 0.8 | 29 | 450 | 470 | 8 | 45 | Comparative Example |
| 25 | c | 1210 | 915 | 0.7 | 16 | 400 | 435 | 6 | 50 | Comparative Example |
| 26 | d | 1215 | 905 | 0.4 | 46 | 390 | 425 | 4 | 25 | Comparative Example |
| 27 | e | 1230 | 895 | 1.1 | 32 | 520 | 510 | 5 | 50 | Comparative Example |
| 28 | f | 1260 | 905 | 1.0 | 67 | 500 | 480 | 3 | 85 | Comparative Example |
| 29 | g | 1240 | 910 | 0.7 | 70 | 420 | 430 | 6 | 60 | Comparative Example |
| 30 | h | 1245 | 900 | 1.0 | 82 | 425 | 440 | 4 | 60 | Comparative Example |
| 31 | i | 1220 | 950 | 0.5 | 78 | 400 | 430 | 3 | 80 | Comparative Example |
| 32 | j | 1290 | 1050 | 0.7 | 57 | 520 | 510 | 7 | 50 | Comparative Example |
| 33 | A | 1250 | 780 | 0.9 | 50 | 430 | 450 | 5 | 35 | Comparative Example |
| 34 | A | 1230 | 1020 | 1.0 | 70 | 525 | 510 | 3 | 45 | Comparative Example |
| 35 | A | 1235 | 910 | 2.9 | 75 | 420 | 415 | 6 | 65 | Comparative Example |
| 36 | A | 1270 | 915 | 0.7 | 4 | 420 | 440 | 3 | 85 | Comparative Example |
| 37 | A | 1260 | 900 | 0.9 | 45 | 310 | 330 | 4 | 55 | Comparative Example |
| 38 | A | 1240 | 920 | 1.3 | 50 | 650 | 630 | 3 | 75 | Comparative Example |
| 39 | A | 1240 | 895 | 0.6 | 37 | 450 | 470 | 25 | 35 | Comparative Example |
| 40 | B | 1220 | 800 | 0.8 | 49 | 430 | 440 | 6 | 55 | Comparative Example |
| 41 | C | 1190 | 1040 | 0.7 | 56 | 390 | 410 | 3 | 50 | Comparative Example |
| 42 | D | 1215 | 920 | 0.4 | 3 | 430 | 460 | 2 | 35 | Comparative Example |
| 43 | F | 1230 | 910 | 0.7 | 34 | 280 | 300 | 6 | 55 | Comparative Example |
| 44 | G | 1250 | 940 | 0.9 | 28 | 670 | 630 | 3 | 65 | Comparative Example |
| 45 | H | 1230 | 915 | 1.0 | 67 | 525 | 510 | 35 | 30 | Comparative Example |

TABLE 3

| | Microstructure | | | | | | Mechanical properties | | | | |
|---|---|---|---|---|---|---|---|---|---|---|---|
| | Area fraction (%) | | | | | | YP | TS | El | u-El | |
| No. | UB | M | γ | M + γ | F | TM | (MPa) | (MPa) | (%) | (%) | Remarks |
| 1 | 88 | 9 | 3 | 12 | 0 | 0 | 1000 | 1232 | 15.9 | 7.1 | Example |
| 2 | 86 | 12 | 2 | 14 | 0 | 0 | 976 | 1195 | 17.8 | 9.2 | Example |
| 3 | 91 | 6 | 3 | 9 | 0 | 0 | 1025 | 1273 | 14.6 | 8.4 | Example |
| 4 | 81 | 14 | 5 | 19 | 0 | 0 | 951 | 1221 | 16.7 | 7.3 | Example |
| 5 | 80 | 14 | 6 | 20 | 0 | 0 | 1068 | 1325 | 12.7 | 6.7 | Example |
| 6 | 87 | 7 | 6 | 13 | 0 | 0 | 1028 | 1228 | 13.8 | 7.2 | Example |
| 7 | 83 | 13 | 4 | 17 | 0 | 0 | 1080 | 1270 | 16.9 | 9.1 | Example |
| 8 | 88 | 7 | 5 | 12 | 0 | 0 | 1102 | 1252 | 16.2 | 8.8 | Example |
| 9 | 80 | 17 | 3 | 20 | 0 | 0 | 1116 | 1298 | 13.9 | 6.1 | Example |
| 10 | 83 | 13 | 4 | 17 | 0 | 0 | 1004 | 1255 | 14.8 | 7.2 | Example |
| 11 | 83 | 14 | 3 | 17 | 0 | 0 | 1023 | 1263 | 14.7 | 7.3 | Example |
| 12 | 90 | 6 | 4 | 10 | 0 | 0 | 1121 | 1350 | 13.8 | 6.5 | Example |
| 13 | 73 | 21 | 6 | 27 | 0 | 0 | 1057 | 1215 | 17.2 | 7.8 | Example |
| 14 | 72 | 21 | 7 | 28 | 0 | 0 | 993 | 1196 | 17.2 | 8.8 | Example |
| 15 | 84 | 12 | 4 | 16 | 0 | 0 | 954 | 1239 | 15.8 | 8.2 | Example |
| 16 | 83 | 13 | 4 | 17 | 0 | 0 | 980 | 1238 | 15.9 | 8.7 | Example |
| 17 | 75 | 19 | 6 | 25 | 0 | 0 | 1010 | 1246 | 16.2 | 9.0 | Example |
| 18 | 78 | 17 | 5 | 22 | 0 | 0 | 1118 | 1285 | 13.9 | 7.1 | Example |
| 19 | 84 | 14 | 2 | 16 | 0 | 0 | 950 | 1203 | 15.9 | 8.1 | Example |
| 20 | 86 | 10 | 4 | 14 | 0 | 0 | 1004 | 1210 | 14.9 | 8.1 | Example |
| 21 | 84 | 11 | 5 | 16 | 0 | 0 | 1036 | 1205 | 15.7 | 9.3 | Example |
| 22 | 88 | 9 | 3 | 12 | 0 | 0 | 1125 | 1278 | 13.5 | 7.5 | Example |
| 23 | 92 | 6 | 2 | 8 | 0 | 0 | 1008 | 1120 | 18.3 | 9.6 | Comparative Example |

TABLE 3-continued

| | Microstructure | | | | | | Mechanical properties | | | | |
|---|---|---|---|---|---|---|---|---|---|---|---|
| | Area fraction (%) | | | | | | YP | TS | El | u-El | |
| No. | UB | M | γ | M + γ | F | TM | (MPa) | (MPa) | (%) | (%) | Remarks |
| 24 | 89 | 7 | 4 | 11 | 0 | 0 | 1265 | 1390 | 13.2 | 3.8 | Comparative Example |
| 25 | 90 | 6 | 4 | 10 | 0 | 0 | 1080 | 1270 | 13.1 | 4.9 | Comparative Example |
| 26 | 68 | 26 | 6 | 32 | 0 | 0 | 1096 | 1260 | 15.2 | 4.8 | Comparative Example |
| 27 | 94 | 4 | 2 | 6 | 0 | 0 | 1081 | 1175 | 16.4 | 6.6 | Comparative Example |
| 28 | 69 | 26 | 5 | 31 | 0 | 0 | 871 | 1340 | 11.8 | 4.2 | Comparative Example |
| 29 | 91 | 8 | 1 | 9 | 0 | 0 | 1089 | 1210 | 13.3 | 4.7 | Comparative Example |
| 30 | 66 | 27 | 7 | 34 | 0 | 0 | 856 | 1380 | 12.9 | 5.1 | Comparative Example |
| 31 | 69 | 24 | 7 | 31 | 0 | 0 | 931 | 1410 | 10.8 | 3.2 | Comparative Example |
| 32 | 67 | 30 | 3 | 33 | 0 | 0 | 833 | 1388 | 11.7 | 4.3 | Comparative Example |
| 33 | 88 | 8 | 4 | 12 | 0 | 0 | 1158 | 1379 | 12.9 | 5.1 | Comparative Example |
| 34 | 87 | 10 | 3 | 13 | 0 | 0 | 863 | 1150 | 13.8 | 7.2 | Comparative Example |
| 35 | 86 | 9 | 5 | 14 | 0 | 0 | 1025 | 1125 | 15.1 | 7.6 | Comparative Example |
| 36 | 82 | 5 | 3 | 8 | 10 | 0 | 882 | 1160 | 13.8 | 7.2 | Comparative Example |
| 37 | 4 | 3 | 1 | 4 | 0 | 92 | 1136 | 1420 | 9.8 | 3.2 | Comparative Example |
| 38 | 0 | 0 | 0 | 0 | 100 | 0 | 840 | 1120 | 14.8 | 7.2 | Comparative Example |
| 39 | 65 | 32 | 3 | 35 | 0 | 0 | 897 | 1150 | 13.7 | 6.3 | Comparative Example |
| 40 | 90 | 7 | 3 | 10 | 0 | 0 | 1126 | 1340 | 12.6 | 5.4 | Comparative Example |
| 41 | 88 | 8 | 4 | 12 | 0 | 0 | 905 | 1175 | 15.9 | 7.1 | Comparative Example |
| 42 | 0 | 0 | 0 | 0 | 100 | 0 | 797 | 960 | 17.8 | 9.2 | Comparative Example |
| 43 | 0 | 0 | 4 | 4 | 0 | 96 | 1358 | 1460 | 8.8 | 3.2 | Comparative Example |
| 44 | 0 | 0 | 0 | 0 | 100 | 0 | 988 | 1110 | 14.7 | 8.3 | Comparative Example |
| 45 | 0 | 96 | 4 | 100 | 0 | 0 | 1163 | 1510 | 7.9 | 3.1 | Comparative Example |

The invention claimed is:

1. A hot-rolled high strength steel sheet comprising a chemical composition containing, in mass %:

C: 0.10% to 0.20%,
Si: 0.7% to 1.4%,
Mn: 2.3% to 4.0%,
P: 0.10% or less,
S: 0.03% or less,
Al: 0.001% to 2.0%,
N: 0.01% or less,
O: 0.01% or less, and
B: 0.0005% to 0.010%, with the balance being Fe and inevitable impurities, and with a MSC defined by the following formula (1) of 3.0 mass % to 4.2 mass %, the hot-rolled high strength steel sheet having a microstructure including:

upper bainite in an area fraction of 70% to 93% as a main phase, and fresh martensite and retained austenite in a total area fraction of 7% to 30%, with the retained austenite having an area fraction of 2% to 7%, and the hot-rolled high strength steel sheet having a mechanical property with a uniform elongation of 6% to 10% and a tensile strength of 1180 MPa to 1400 MPa:

$$\text{MSC (mass \%)}=\text{Mn}+0.2\times\text{Si}+1.7\times\text{Cr}+2.5\times\text{Mo} \quad (1)$$

where each element symbol in the formula (1) represents a content, in mass %, of a corresponding element and is taken to be 0 when the corresponding element is not contained.

2. The hot-rolled high strength steel sheet according to claim 1, wherein the chemical composition further contains, in mass %, at least one of the group consisting of a) one or both of Cr: 1.0% or less and Mo: 1.0% or less, b) at least one selected from the group consisting of
Cu: 2.0% or less,
Ni: 2.0% or less,
Ti: 0.3% or less,
Nb: 0.3% or less, and
V: 0.3% or less, c) Sb: 0.005% to 0.020%, d) at least one selected from the group consisting of
Ca: 0.01% or less,
Mg: 0.01% or less, and
REM: 0.01% or less.

3. A method of producing the hot-rolled high strength steel sheet according to claim 1, the method comprising:

heating a steel material having the chemical composition to a heating temperature of 1150° C. or more;

subjecting the heated steel material to hot rolling to obtain a hot-rolled steel sheet under a set of conditions including a rolling finish temperature of (RC−50° C.) or more and (RC+150° C.) or less;

cooling the hot-rolled steel sheet under a set of conditions including a time from the end of the hot rolling to the start of the cooling of 2.0 s or less, an average cooling rate of 5° C./s or more, and a cooling stop temperature of Trs or more and (Trs+250° C.) or less;

coiling the hot-rolled steel sheet after the cooling under a set of conditions including a coiling temperature of Trs or more and (Trs+250° C.) or less; and cooling the hot-rolled steel sheet after the coiling to 100° C. or less at an average cooling rate of 20° C./s or less, wherein the RC is defined by the following formula (2) and the Trs is defined by the following formula (3):

$$\text{RC}(^\circ\text{C.})=800+100\times\text{C}+100\times\text{N}+10\times\text{Mn}+700\times\text{Ti}+5000\times\text{B}+10\times\text{Cr}+50\times\text{Mo}+2000\times\text{Nb}+150\times\text{V} \quad (2)$$

$$\text{Trs}(^\circ\text{C.})=500-450\times\text{C}-35\times\text{Mn}-15\times\text{Cr}-10\times\text{Ni}-20\times\text{Mo} \quad (3)$$

where each element symbol in the formulas (2) and (3) represents a content, in mass %, of a corresponding element and is taken to be 0 when the corresponding element is not contained.

4. A method of producing the hot-rolled high strength steel sheet according to claim 2, the method comprising:

heating a steel material having the chemical composition to a heating temperature of 1150° C. or more;

subjecting the heated steel material to hot rolling to obtain a hot-rolled steel sheet under a set of conditions including a rolling finish temperature of (RC−50° C.) or more and (RC+150° C.) or less;

cooling the hot-rolled steel sheet under a set of conditions including a time from the end of the hot rolling to the start of the cooling of 2.0 s or less, an average cooling rate of 5° C./s or more, and a cooling stop temperature of Trs or more and (Trs+250° C.) or less;

coiling the hot-rolled steel sheet after the cooling under a set of conditions including a coiling temperature of Trs or more and (Trs+250° C.) or less; and cooling the hot-rolled steel sheet after the coiling to 100° C. or less at an average cooling rate of 20° C./s or less, wherein the RC is defined by the following formula (2) and the Trs is defined by the following formula (3):

$$RC(^\circ C.)=800+100\times C+100\times N+10\times Mn+700\times Ti+5000\times B+10\times Cr+50\times Mo+2000\times Nb+150\times V \quad (2)$$

$$Trs(^\circ C.)=500-450\times C-35\times Mn-15\times Cr-10\times Ni-20\times Mo \quad (3)$$

where each element symbol in the formulas (2) and (3) represents a content, in mass %, of a corresponding element and is taken to be 0 when the corresponding element is not contained.

5. The hot-rolled high strength steel sheet according to claim 1, wherein the area fraction of the retained austenite is 4% or more to 7%.

* * * * *